US005447483A

United States Patent [19]

Liang

[11] Patent Number: 5,447,483

[45] Date of Patent: Sep. 5, 1995

[54] CRAWLING EXERCISER

[76] Inventor: Fa-Kuang Liang, B1, No. 20 Shian-Man St., Taipei, Taiwan

[21] Appl. No.: 318,929

[22] Filed: Oct. 6, 1994

[51] Int. Cl.[6] ..... A63B 21/00

[52] U.S. Cl. ..... 482/132; 482/96; 280/218

[58] Field of Search ..... 482/132, 95, 96, 907; 280/218, 200, 1.181, 1.191; 446/290

[56] References Cited

U.S. PATENT DOCUMENTS

| | | | |
|---|---|---|---|
| 2,539,640 | 1/1951 | Sebel | 280/218 |
| 3,101,944 | 8/1963 | Ceacig | 482/132 |
| 3,572,701 | 3/1971 | Aganian | 482/132 |
| 3,589,720 | 6/1971 | Aganian | 482/132 |
| 4,225,132 | 9/1980 | Archambault | 482/132 |
| 4,595,197 | 6/1986 | Hagstrom et al. | 482/132 |

*Primary Examiner*—Lynne A. Reichard
*Attorney, Agent, or Firm*—Pro-Techtor International

[57] ABSTRACT

A crawling exercise including an elongated base frame rod; a front locating device and a rear locating device fastened to said elongated base frame; a rear wheel frame unit having a cross frame rod supported between two wheels and fixed to one end of the elongated base frame rod by a connector; and a front wheel frame unit having a cross frame rod supported between two wheels and coupled to the elongated base frame rod by a connector and reciprocated by the player along the elongated base frame rod between the front and rear locating devices.

5 Claims, 8 Drawing Sheets

CRAWLING EXERCISER

BACKGROUND OF THE INVENTION

The present invention relates to exercising apparatus, and relates more particularly to a crawling exerciser.

It is well-known that having suitable exercises daily is helpful to the health. Adequate exercising amount is important to people working in offices. Various exercising apparatus, including rowing machines, step machines, chest developers, etc., have been disclosed for indoor exercises, and have appeared on the market. These exercising apparatus are commonly designed for exercising specific parts of the body. Few exercising apparatus provide the function of exercising the whole body.

SUMMARY OF THE INVENTION

The present invention has been accomplished under the circumstances in view. It is one object of the present invention to provide a crawling exerciser which permits the player to exercise the hands, the legs as well as the body thoroughly. It is another object of the present invention to provide a crawling exerciser which can be conveniently adjusted according to different exercising amount.

According to one aspect of the present invention, the crawling exerciser comprises an elongated base frame rod; a front locating device and a rear locating device fastened to said elongated base frame; a rear wheel frame unit having a cross frame rod supported between two wheels and fixed to one end of the elongated base frame rod by a connector; and a front wheel frame unit having a cross frame rod supported between two wheels and coupled to the elongated base frame rod by a connector and reciprocated by the player along the elongated base frame rod between the front and rear locating devices. When in play, the legs and the hands are respectively placed on the cross frame rod of the rear wheel frame unit, and then the front wheel frame unit is reciprocated along the base frame rod between the front and rear locating devices.

According to another aspect of the present invention, the front and rear locating devices can be loosened and then fixed in place, therefore the distance between the front and rear locating devices can be conveniently adjusted as desired.

DETAILED DESCRIPTION OF THE PREFERRED EMBODIMENT

Figure 1:
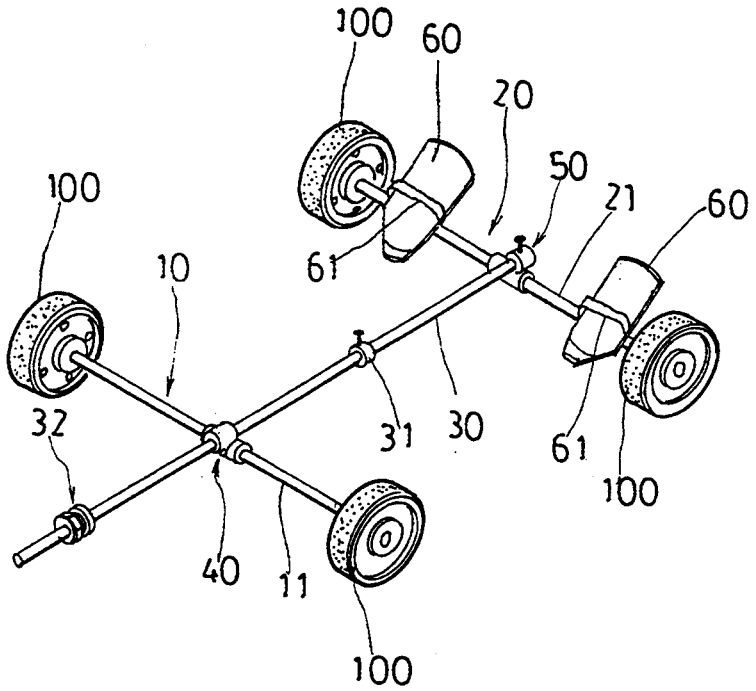
FIG. 1 is an elevational view of a crawling exerciser according to one embodiment of the present invention.

Referring to FIG. 1, a crawling exerciser in accordance with the present invention is generally comprised of a front wheel frame unit 10, a rear wheel frame unit 20, and a base frame rod 30. The front and rear wheel frame units 10 and 20 are joined by the base frame rod 30. Each wheel frame unit 10 or 20 comprises a cross frame rod 11 or 21 having two wheels 100 at two opposite ends. The base frame rod 30 is coupled to the cross frame rods 11 and 21 of the front and rear wheel frame units 10 and 20 by a front wheel frame connector 40 and a rear wheel frame connector 50.

Figure 2:
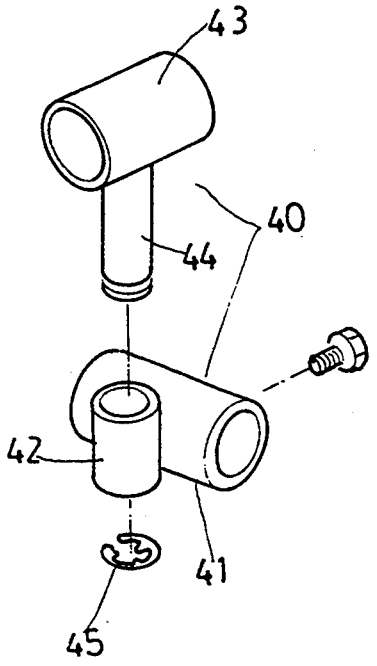
FIG. 2 is an exploded view of a front wheel frame connector according to the present invention.
Figure 3:
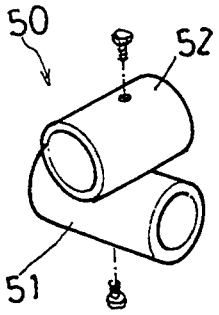
FIG. 3 shows a rear wheel frame connector according to the present invention.

Referring to FIGS. 2 and 3 and FIG. 1 again, the front wheel frame connector 40 comprises a transverse tube 41 having a vertical barrel 42 vertically disposed at one side, and a longitudinal tube 43 having a vertical plug portion 44 perpendicularly extended from the outside wall in the middle. The vertical plug portion 44 of the longitudinal tube 43 is inserted into the vertical barrel 42 of the transverse tube 41 and then retained in place by a clamp 45. When installed, the transverse tube 41 of the front wheel frame connector 40 is fixedly mounted around the cross frame rod 11 of the front wheel frame unit 10 in the middle, and the longitudinal tube 43 is mounted around the base frame rod 30 and can be moved along the base frame rod 30. The rear wheel frame connector 50 is comprised of a transverse tube 51 fixedly mounted around the cross frame rod 21 of the rear wheel frame unit 20 in the middle, and a longitudinal tube 52 welded to the transverse tube 51 and fixedly mounted around the rear end of the base frame rod 30.

Figure 4:
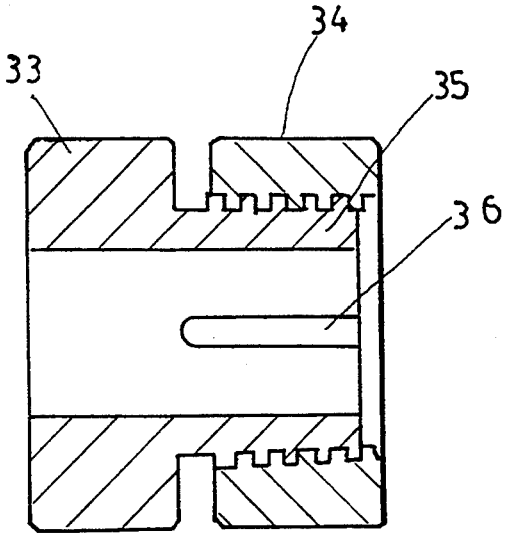
FIG. 4 is a sectional view in an enlarged scale of a front locating device according to the present invention.

Referring to FIG. 4 and FIG. 1 again, a front locating device 32 and a rear locating device 31 are mounted around the base frame rod 30 and fixed in position to limit the moving distance of the front wheel connector 40 (and the front wheel frame unit 10) along the the base frame rod 30. The rear locating device 31 can be simply a ring sleeved on the base frame rod 30 and fixed in position by a tightening up screw. The front locating device 32, as shown in FIG. 4, comprises a mounting ring 33 having a screw tube 35 and longitudinal splits 36 on the screw tube 35, and a tapered lock nut 34 threaded onto the screw tube 35. When the lock nut 34 is turned inwards, the split screw tube 35 is compressed inwards, and therefore the front locating device 32 is fixed to the base frame rod 30. On the contrary, when the lock nut 34 is turned outwards, the split screw tube 35 is released from the compression force, and therefore the front locating device 32 can be moved along the base frame rod 30.

Figure 5:
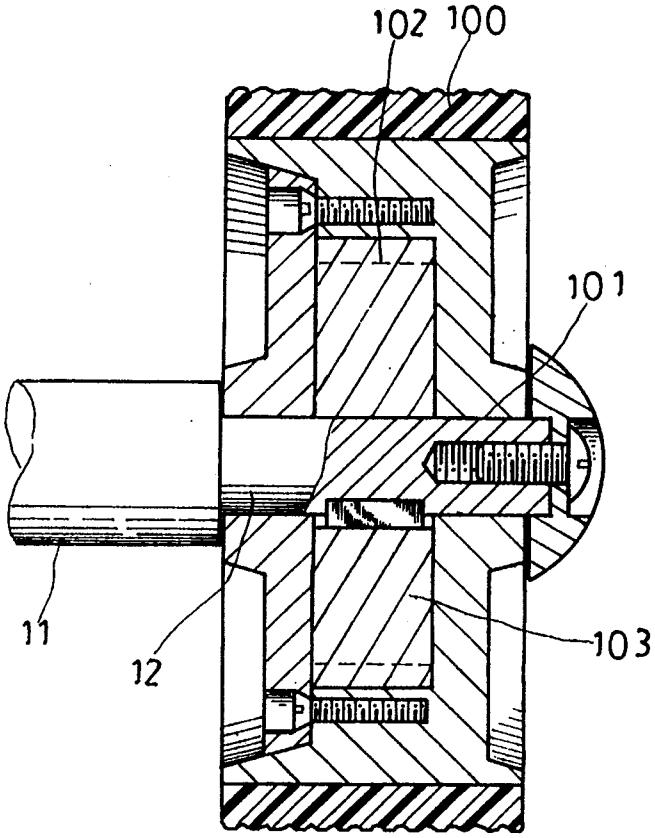
FIG. 5 is a sectional view of a wheel for the crawling exerciser shown in FIG. 1, showing an one-way ratchet wheel mounted within a recessed hole thereof.
Figure 6:
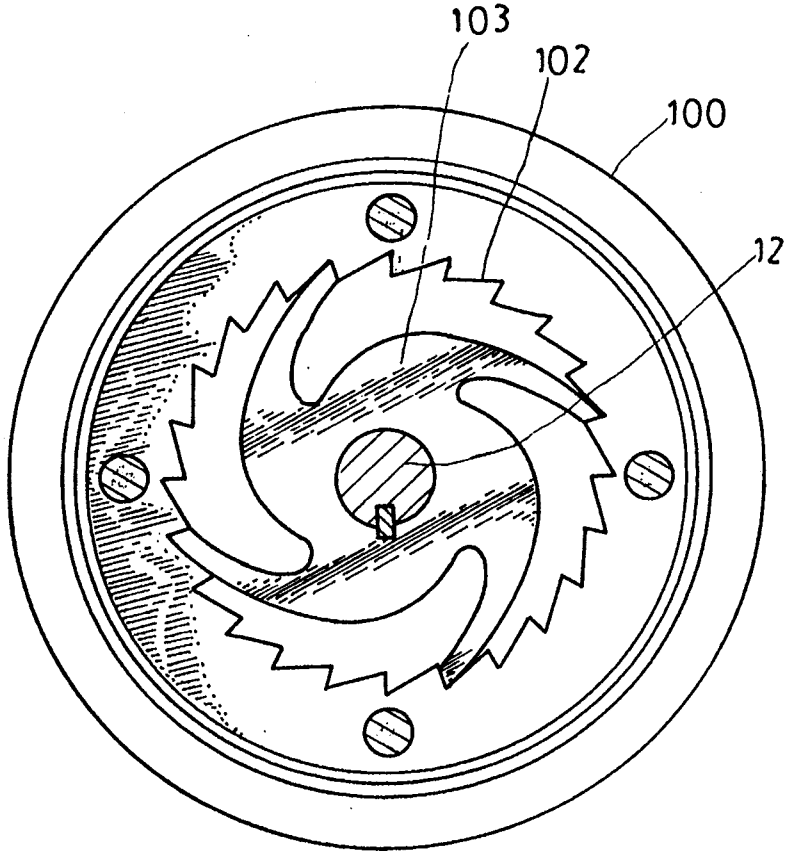
FIG. 6 is a side view of FIG. 5.

Referring to FIGS. 5 and 6, the wheel 100 has a center through hole 101, which receives the wheel axle 12 at one end of the cross frame rod 11 (or 21), a recessed hole 102, and an one-way ratchet wheel 103 received in the recessed hole 102 and mounted around the wheel axle 12 to stop the cross frame rod 11 (or 21) from reverse rotation.

Referring to FIG. 1 again, two foot plates 60 are fixed to the cross frame rod 21 of the rear wheel frame unit 20, each foot plate 60 having a toe strap 61.

Figure 7:
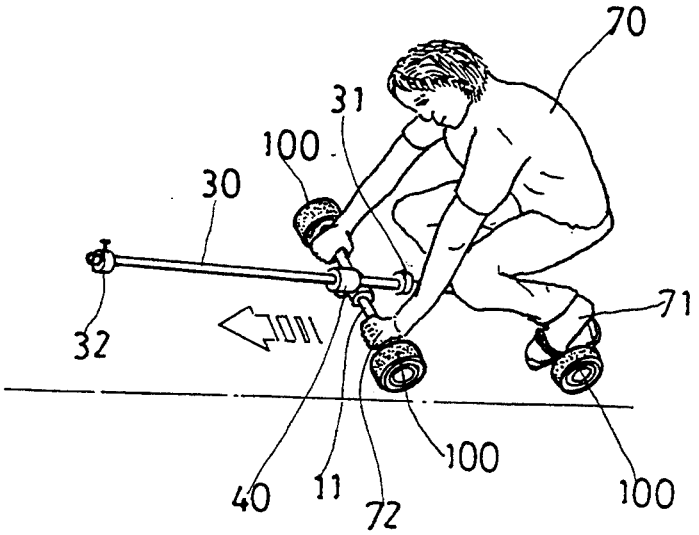
FIG. 7 is an applied view of the crawling exerciser of FIG. 1.
Figure 8:
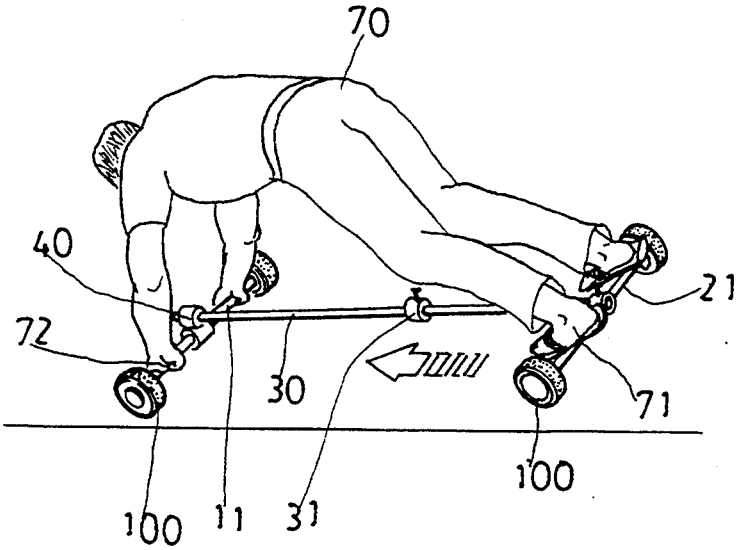
FIG. 8 shows the front wheel frame unit of the crawling exerciser of FIG. 7 moved forwards.
Figure 9:
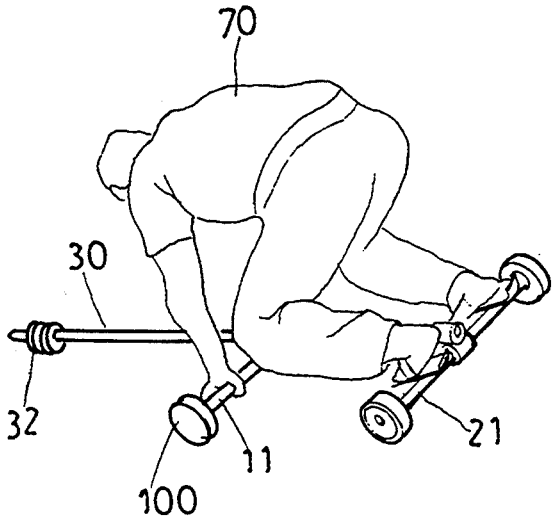
FIG. 9 shows the front wheel frame unit of the crawling exerciser of FIG. 8 moved backwards.

The operation of the aforesaid crawling exerciser is outlined hereinafter with reference to FIGS. 7, 8, and 9. The player 70 must sit on the heels with the feet 71 fastened to the foot plates 60 and the hands 72 grasping the cross frame rod 11 of the front wheel frame unit 10 (as shown in FIG. 7). When ready, the hands 72 are extended out to push the front wheel frame unit 10 forwards along the base frame rod 30 and the feet 71 are pushed backwards in direct reversed to the hands 72 (see FIG. 8). When the front wheel frame unit 10 is stopped by the front locating device 32, the hands 72 and the feet 71 are pulled inwards to move the front wheel frame unit 10 toward the rear wheel frame unit 20 (see FIG. 9). When the front wheel frame unit 10 is stopped by the rear locating device 31, the hands 72 are extended out to move the front wheel frame unit 10 outwards toward the front locating device 32 again. The play may change the locations of the front and rear locating devices 32 and 31 to adjust the moving distance of the front wheel frame unit 10 according to one's physical conditions or desire of exercising amount.

Figure 10:
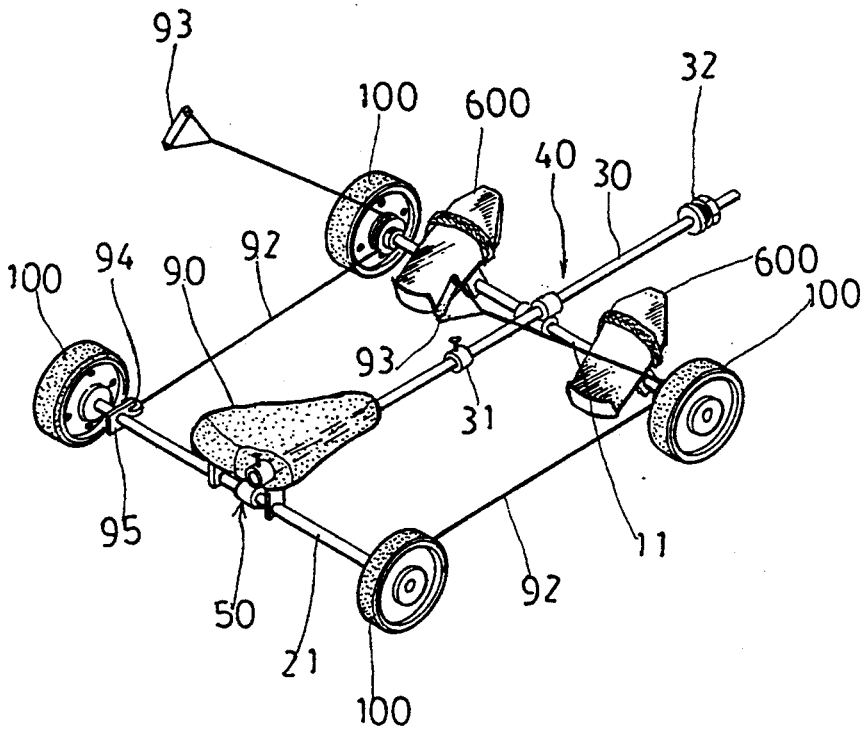
FIG. 10 is an elevational view of an alternate form of the crawling exerciser of the present invention.
Figure 11:
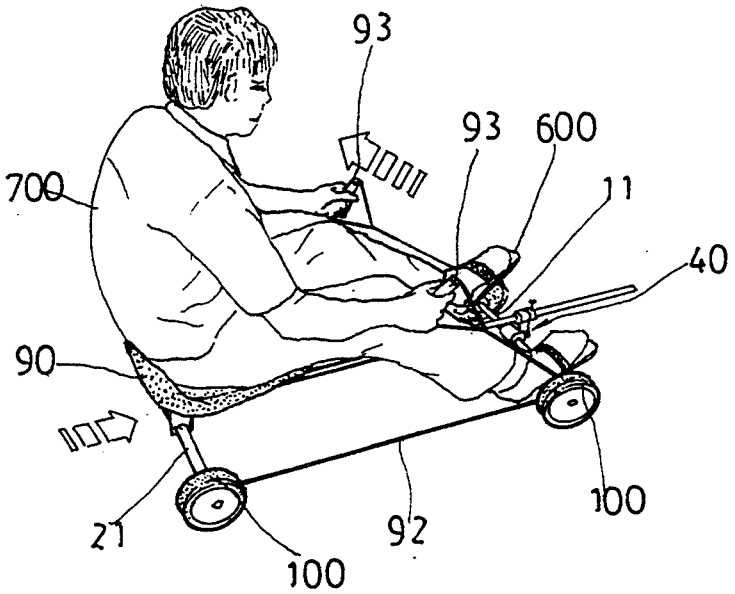
FIG. 11 is an applied view of the crawling exerciser of FIG. 10.

FIG. 10 shows an alternate form of the crawling exerciser. The alternate form eliminates the arrangement of the foot plates 60 on the cross frame rod 21 of the rear wheel frame unit 20. Alternatively, two foot plates 600 are mounted on the cross frame rod 11 of the front wheel frame unit 10, a saddle 90 is mounted on the cross frame rod 21 of the rear wheel frame unit 20, and two pull ropes 92 are provided having each one end 94 fixed to either end of the cross frame rod 21 of the rear wheel frame unit 20 by a respective fixture 95 and an opposite end inserted through a respective rope guide 91 on the wheel 100 at either end of the front wheel frame unit 10 and coupled to a respective handle 93. When in use, as shown in FIG. 11, the player 700 sits on the saddle 90 with the feet fastened to the foot plates 600 and the hands grasping the handles 93 of the pull ropes 92. When the handles 93 are pulled toward the body of the player 700, the front wheel frame unit 10 is moved from the front locating device 32 toward the rear locating device 31. When the handles 93 are released, the front wheel frame unit 10 is pushed outwards from the rear locating device 31 toward the front locating device 32 by the feet.

It is to be understood that the drawings are designed for purposes of illustration only, and are not intended as a definition of the limits and scope of the invention disclosed.

What is claimed is:

1. A crawling exerciser comprising:

an elongated base frame rod;

a front locating device and a rear locating device fastened to said elongated base frame;

a rear wheel frame unit having a cross frame rod supported between two wheels and fixed to one end of said elongated base frame rod by a connector; and a front wheel frame unit having a cross frame rod supported between two wheels and coupled to said elongated base frame rod by a connector and reciprocated by the player along said elongated base frame rod between said front and rear locating devices.

2. The crawling exerciser of claim 1 wherein the wheels of said front and rear wheel frame units each comprises a center through hole, which receives one end of the cross frame rod of said front or rear wheel frame unit, a recessed hole, and an one-way ratchet wheel received in said recessed hole and mounted around the respective cross frame rod to stop the respective cross frame rod from reverse rotation.

3. The crawling exerciser of claim 1 wherein said rear locating device is comprised of a ring mounted around said base frame rod near said rear wheel frame unit and fixed in position by a tightening up screw; said front locating device is comprised of an externally threaded split ring mounted around said base frame rod at an opposite end remote from said rear wheel frame unit and a tapered lock nut threaded onto said externally threaded split ring to fix it to said base frame rod.

4. The crawling exerciser of claim 1 wherein said rear wheel frame unit further comprises two foot plates fixedly mounted on the cross frame rod of said rear wheel frame unit near two opposite ends thereof.

5. The crawling exerciser of claim 1 further comprising two foot plates fixedly mounted on the cross frame rod of said front wheel frame unit, a saddle fixedly mounted on the cross frame rod of said rear wheel frame unit, and two pull ropes each having one end fixed to one end of the cross frame rod of said rear wheel frame unit by a respective fixture and an opposite end inserted through a respective rope guide on the wheel at one end of said front wheel frame unit and coupled to a respective handle.

* * * * *